United States Patent [19]

Corman

[11] 4,084,415

[45] Apr. 18, 1978

[54] CIGARETTE CASE WITH TIMER

[76] Inventor: Warren Corman, 59 Vicksburg St., San Francisco, Calif. 94114

[21] Appl. No.: 779,048

[22] Filed: Mar. 18, 1977

[51] Int. Cl.[2] ..... G04B 19/02; G04B 37/12; E05B 43/00

[52] U.S. Cl. ..... 70/269; 58/125 B; 58/152 R; 70/272

[58] Field of Search ..... 58/53–55, 58/88 R, 88 E, 74, 152 R, 152 B; 70/272, 267, 268, 269; 194/18; 220/324; 221/15; 206/263

[56] References Cited

U.S. PATENT DOCUMENTS 1,207,296 12/1916 Kastor ..... 58/152 R 2,681,560 6/1954 Shuttleworth et al. ..... 221/15

FOREIGN PATENT DOCUMENTS 369,072 6/1963 Switzerland ..... 58/152 R

*Primary Examiner*—Edith S. Jackmon
*Attorney, Agent, or Firm*—Gordon Wood

[57] ABSTRACT

A cigarette case provided with a timer to prevent opening of the case except after a predetermined interval of time. A manually settable timer is secured to one side of the case and a lid flap having a clasp overlie said side. The timer is provided with a dial for setting the same and said dial is formed with a slot so that the case may be opened in only one position of the timer.

4 Claims, 2 Drawing Figures

CIGARETTE CASE WITH TIMER

BRIEF DESCRIPTION OF THE INVENTION

This invention relates to a cigarette case provided with a timer to assist the user in reducing his cigarette consumption.

Heretofore numerous attempts have been made to provide timing devices on cigarette cases so that the case may not be opened until after a predetermined length of time has expired. Such prior attempts have been made, for the most part, very complicated and also so expensive as to discourage their use as a practical matter.

The main object of the present invention is the provision of a cigarette case incorporating a timer which is inexpensive to make and easy to use.

Other objects and advantages will be apparent from the following specification and from the claims.

DETAILED DESCRIPTION

Figure 1:
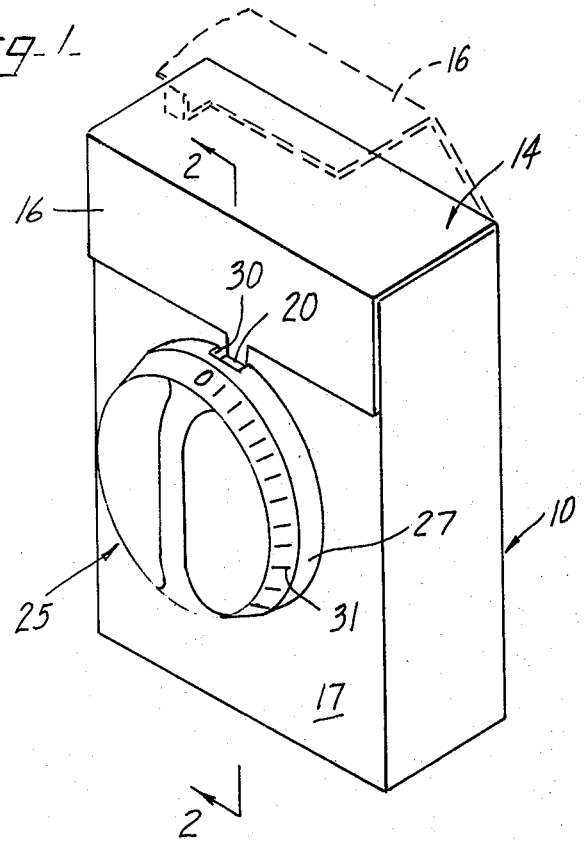
FIG. 1 is a perspective of a cigarette case incorporating the invention.

The invention comprises a generally rectangular case generally designated 10 which may be formed of an inner layer 11 of inexpensive material such as paperboard or the like. An outer thinner layer 12 of leather or plastic may be adherently secured to the inner layer 11 to form the sidewalls of the case.

Integral with the rear sidewall 13 of the case and hingedly secured thereto is a lid 14 covering the top 15 of the case and which lid includes a flap 16 which is adapted to overlie the front side 17 of the case. An integral extension to the flap 16 is provided to form a clasp 20.

Figure 2:
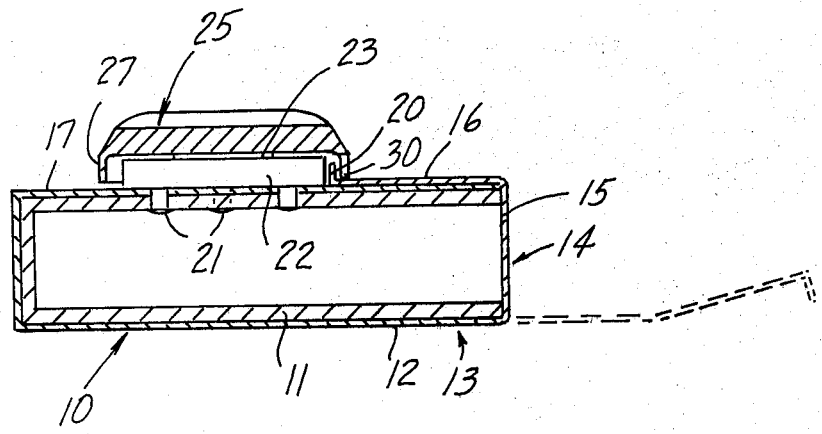
FIG. 2 is a cross section taken in a plane indicated by lines 2—2 of FIG. 1.

Fixedly secured to the front side 17 of the case as by rivets 21 is a conventional timer 22 having a rotatable shaft 23. Timers of this type are well known and the same are spring wound and have a front dial which is settable by the user to whatever desired time interval is required. In this case the shaft 23 of timer 22 is provided with a dial generally designated 25 and including a peripherally extending flange 27 extending toward the case 10. The above described clasp 20 is adapted to underlie the flange 27 so that the flap 16 cannot normally be raised from the position shown in FIGS. 1 and 2.

In order to permit the case to be opened after the desired interval of time, the peripheral flange 27 is provided with a slot 30 which, when the desired time interval has elapsed, registers with the clasp 20 thereby permitting the lid 14 to be opened.

The front side of the dial 25 may be provided with indicia 31 for indicating the desired time interval.

I claim:

1. A cigarette case including a box having a swingable lid for closing the same, said lid having a flap superposed over one side of said box when said lid is closed, a clasp on said flap adjacent the free edge thereof, a timer secured to said one side, said timer including an outer rotatable dial normally overlying said clasp for preventing swinging of said flap, said dial being formed with a slot adapted to register with said clasp in one position of said dial to permit opening of said flap and lid.

2. A case according to claim 1 wherein said dial includes an axially extending peripheral flange, said slot being in said flange.

3. A case according to claim 1 wherein said dial is calibrated around its periphery in units of time.

4. A case according to claim 1 wherein said timer is of the type which is spring wound and which is manually settable for different time periods.

* * * * *